US011584900B2

(12) United States Patent
Knocke et al.

(10) Patent No.: US 11,584,900 B2
(45) **Date of Patent: *Feb. 21, 2023**

(54) METHOD FOR REMOVING ONE OR MORE OF: COATING, CORROSION, SALT FROM A SURFACE

(71) Applicant: Corrosion Innovations, LLC, Pasadena, TX (US)

(72) Inventors: James J. Knocke, Pasadena, TX (US); Marlin Lester, Pasadena, TX (US)

(73) Assignee: Corrosion Innovations, LLC, Pasadena, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/321,391

(22) Filed: May 14, 2021

(65) Prior Publication Data

US 2022/0033733 A1 Feb. 3, 2022

Related U.S. Application Data

(60) Provisional application No. 63/025,101, filed on May 14, 2020, provisional application No. 63/041,053, filed on Jun. 18, 2020.

(51) Int. Cl.
*C11D 3/30* (2006.01)
*B08B 3/08* (2006.01)
(Continued)

(52) U.S. Cl.
CPC ..... *C11D 1/42* (2013.01); *B08B 3/08* (2013.01); *B08B 3/10* (2013.01); *C11D 3/30* (2013.01);
(Continued)

(58) Field of Classification Search
CPC ... C11D 3/30; C11D 11/0023; C11D 11/0041; B08B 3/08; B08B 3/10
(Continued)

(56) References Cited

U.S. PATENT DOCUMENTS 3,720,547 A 3/1973 Melotik
5,089,064 A 2/1992 Reghi
(Continued)

FOREIGN PATENT DOCUMENTS

CN 106140671 A 11/2016
JP 11274130 A 10/1999
(Continued)

OTHER PUBLICATIONS

Web Article: "Deanol",Compound Summary, C4H11NO—PubChem, May 14, 2021 (59 pages) Retrieved: https://pubchem.ncbi.nlm.nih.gov/compound/Deanol#section=Uses.
(Continued)

*Primary Examiner* — Gregory R Delcotto
(74) *Attorney, Agent, or Firm* — Fox Rothschild LLP

(57) ABSTRACT

Embodiments of the present methods and solutions that operate to prepare a metal surface to be ready for coating or primer. The surface is operated on using mechanical or pressure impingement operation in conjunction with application of medium comprising dimethylethanolamine (DMEA) and water (DMEA diluted in water). Embodiments of the present invention can perform the wash or decontamination to leave a clean surface that provides excellent performance in durability and rust resistance after being coated or primed. Other cleaning chemicals if added may reduce the performance and interfere with the desired objective. Other surfaces are contemplated.

25 Claims, 3 Drawing Sheets

(51) Int. Cl.
*B08B 3/10* (2006.01)
*C11D 1/42* (2006.01)
*C11D 11/00* (2006.01)

(52) U.S. Cl.
CPC ..... *C11D 11/0023* (2013.01); *C11D 11/0041* (2013.01)

(58) Field of Classification Search
USPC ..... 510/245, 254, 499; 134/39, 40, 41
See application file for complete search history.

(56) References Cited

U.S. PATENT DOCUMENTS

| | | | | |
|---|---|---|---|---|
| 5,527,203 | A * | 6/1996 | Cook | B24C 11/00 451/38 |
| 5,868,873 | A | 2/1999 | Brown et al. | |
| 5,997,658 | A | 12/1999 | Peters et al. | |
| 6,095,883 | A | 8/2000 | Elizondo et al. | |
| 6,367,486 | B1 | 4/2002 | Lee et al. | |
| 6,436,475 | B1 | 8/2002 | Adler et al. | |
| 6,686,325 | B2 | 2/2004 | Hoyt et al. | |
| 7,078,371 | B2 | 7/2006 | Ikemoto | |
| 7,699,940 | B2 | 4/2010 | McKay et al. | |
| 7,749,319 | B2 | 7/2010 | Inbe et al. | |
| 7,956,026 | B2 | 6/2011 | Kobayashi et al. | |
| 8,231,733 | B2 | 7/2012 | Egbe et al. | |
| 8,927,669 | B2 | 1/2015 | Pfeiffer et al. | |
| 9,193,943 | B1 | 11/2015 | Hatle et al. | |
| 9,758,877 | B2 | 9/2017 | Esposito et al. | |
| 9,782,804 | B1 | 10/2017 | Hatle et al. | |
| 10,351,801 | B2 | 7/2019 | Martinez-Crowley et al. | |
| 10,508,255 | B2 | 12/2019 | Hori et al. | |
| 2004/0054044 | A1 | 3/2004 | Bittner et al. | |
| 2004/0121927 | A1* | 6/2004 | McDonald | C11D 7/26 510/245 |
| 2009/0093389 | A1 | 4/2009 | Tijanic et al. | |
| 2011/0111130 | A1 | 5/2011 | Hickl et al. | |
| 2014/0007900 | A1 | 1/2014 | Fish | |
| 2014/0102486 | A1 | 4/2014 | Doyel et al. | |
| 2014/0264151 | A1 | 9/2014 | Ko | |
| 2015/0038391 | A1* | 2/2015 | De Wit | C23G 5/06 510/276 |
| 2016/0327714 | A1 | 11/2016 | Patrick et al. | |
| 2017/0191376 | A1 | 7/2017 | Eriksen et al. | |
| 2017/0334036 | A1 | 11/2017 | Turner et al. | |
| 2019/0016999 | A1 | 1/2019 | Sakamuri et al. | |

FOREIGN PATENT DOCUMENTS

| | | | |
|---|---|---|---|
| JP | 3040804 | B2 | 5/2000 |
| JP | 2003142443 | A | 5/2003 |
| JP | 2003155586 | A | 5/2003 |
| JP | 2012201741 | A | 10/2012 |
| JP | 2014051575 | A | 3/2014 |
| JP | 5937854 | A | 6/2016 |
| WO | 8603513 | A1 | 6/1986 |
| WO | WO2019188307 | A1 | 10/2019 |

OTHER PUBLICATIONS

John Sparks, "The Basics Of Alkaline in Process Cleaning For Metal Substrates", Oakite Products, Inc. Berkeley Heights, New Jersey (2021) 16 pages Retrieved: https://p2infohouse.org/ref/12/11201.pdf.

Web Article: "Surface Pretreatment," Adhesives.Orge, Sealants.Org (2021) 2 pages Retrieved: https://www.adhesives.org/adhesives-sealants/adhesives-sealants-overview/use-of-adhesives/surface-treatment/surface/pretreatment.

Web Article: "The Basics Of Pre-Treatment, 'Surface Finishing 101'" (2021) 29 pages Retrieved: https://cdn.ymaws.com/www.ccaiweb.com/resource/collection/38C19C4E-71DD-46D3-A2F3-C7F499367278/MN18%20-%20Van%20Duyne%20-%20Pretreatment%20101-PROTECTED.pdf.

Web Article: George Batis, "Evaluation Of Organic Corrosion Inhibitor Effectiveness Into The Concrete" (May 14, 2021) 8 pages Retrieved: https://www.researchgate.net/publication/251145515_Evaluation_of_organic_corrosion_inhibitor_effectiveness_into_the_concrete.

R.T. Loto et al., I"nhibition Effect of N, N'-Dime hylaminoethanol on the Corrosion of Austenitic Stainless Steel Type 304 in 3M H2 SO4", Int. J. Electrochem. Sci., 7, ( 10763-10778 (2012) 16 pages Retrieved: http://www.electrochemsci.org/papers/vol7/71110763.pdf.

International Search Report and Written Opinion from PCT/IB21/54181 dated Aug. 18, 2021.

* cited by examiner

METHOD FOR REMOVING ONE OR MORE OF: COATING, CORROSION, SALT FROM A SURFACE

This application claims priority to U.S. Provisional Application No. 63/025,101, filed May 14, 2020 and U.S. Provisional Application No. 63/041,053, filed Jun. 18, 2020, the entirety of each which is incorporated by reference.

FIELD OF THE INVENTION

The present invention generally relates to a method to treat a surface as to afford a surface that is substantially free of contaminants preferably without leaving a film or depositing a material that will mask or trap contaminants.

BACKGROUND OF THE INVENTION

In the field of industrial maintenance and preparation of metal structures in facilities such as oil platforms, refineries, power plants, or factories, various surface preparation processes have been developed and are used to remove contaminants as a precursor to applying primer or protective coating to the metal structures. These processes have the objective of providing a prepared surface with low to no detectable soluble salts. There are a wide range of factors that affect the suitability and effectiveness of these processes. For example, many of the facilities are outdoors and require a large scale operation to prepare all of the surfaces at the facility. This can involve significant time, cost, and resources. Some facilities are outdoor with surfaces that are also subject to various weather conditions after the process and before paint or primer is applied. The exposure to environmental conditions has historically degraded the effectiveness of the various known surface preparation processes. Also, for many decades, impingement was the standard used in the industry for removal of corrosion and aged coatings. More recently, acidic cleaning processes have been introduced in this field that involve the manual application of an acidic gel to the metal surfaces followed by an alkaline rinse to remove flash rust and other surface contaminants. The two approaches are distinct in that they involve different considerations with respect to time of usage, costs, safety, effectiveness, and required adjunct steps or processes.

Prior teachings used amines, including triethanolamine, to form a film and temporarily block oxygen and moisture from a blasted surface to prevent flash rusting prior to protective coating application. This is a preferred or accepted teaching in the industry from, for example, U.S. Pat. No. 4,590,100. Others (Chlor*Rid U.S. Pat. No. 5,609,692) used organic acid salts to wash off the soluble salts, which will eventually lead to under coating corrosion of steel substrates. One recent product on the market (Cleanwirx 207 advertised as Patent Pending) is purported to be a volatile amine and a blend of sodium/amine sulfate salts. All three of these known types of treatment systems will leave behind high levels of conductivity from the solutions that are supposedly to reduce various surface contaminants, including water-soluble salts. All of the three systems claim to increase coating adhesion; however, this only applies to the initial cure adhesion. All three systems will lead to premature coating failure depending on the length of time it takes for moisture vapor and oxygen to migrate through the coating. These systems can be used as post-blast rinses, or in conjunction with water-based blasting processes but the performance is not known to be different based on our research. Water quality with a spray or blast application can influence performance of the above-mentioned systems but we have found the performance is still inferior to embodiments of the new invention.

Another drawback of the prior art that used amines to form a film is that those techniques were found, over time, to result in damage or buildup of films or scales in ceramic rods or the dynamic seal can be damaged in the UHP equipment, which can cause significant delays.

It is critical for the owners of these facilities to have highly effective, quick, efficient, and accessible solutions for their maintenance and surface preparation needs.

SUMMARY OF THE INVENTION

The claimed invention is related to methods for metal decontamination and a cleaning solution for preparing a metal surface to be treated. In some embodiments, the method comprises cleaning a metal surface by applying a medium or a cleaning solution consisting essentially of dimethylethanolamine and water. The method further comprises applying a mechanical cleaning operation or blast pressure cleaning operation to the metal surface, and without applying a caustic or chemical cleaning operation to the metal surface prior to applying the medium. In the medium, an amount of the dimethylethanolamine is about 0.05% or above by weight, based on the total weight of the dimethylethanolamine and the water. For example, the dimethylethanolamine is about 0.05% or above weight, up to or at potentially about 40%, by weight or preferably up to or at about 18.15% by weight, based on the total weight of the dimethylethanolamine and the water. Alternatively, the amount of the dimethylethanolamine is about 0.18% or above by weight, based on the total weight of the dimethylethanolamine and the water. Still alternatively, the amount of the dimethylethanolamine is about 0.72% or above by weight, based on the total weight of the dimethylethanolamine and the water. The water may comprise RO, DI, purified water or tap water, or equivalents. The treatment leaves the surface with about 0-3 ppm of chlorides, about 0-3 ppm of nitrates, and about 0-10 ppm of sulfates without leaving a film on the surface depending on the quality of water used.

In preferred embodiments, the medium consists of the dimethylethanolamine and the water. The medium has minimal environmental impact. In some embodiments, the medium is applied to the surface in a soak bath. Optionally, the medium is only applied after the preparation and the mechanical or pressure cleaning operation. In desired embodiments, the treatment leaves the surface with about 0-3 ppm of chlorides, about 0-3 ppm of nitrates, and about 0-3 ppm of sulfates when using DI water as the diluent.

In some embodiments, an abrasive material is applied using vapor abrasive blasting in conjunction with the medium being applied to the surface. Preferably, the medium is applied at the same time or after applying a mechanical cleaning operation or pressure cleaning operation or both, where the operation can include an abrasive, ultra-high pressure, vapor blasting, slurry blasting, hand, mechanical, or laser blasting preparation of the surface.

In some embodiments, a non-fugitive electron transport material is added to the medium as a surface passivator. For example, the non-fugitive electron transport materials may include a. a conjugated polymer; b. a high charge polymer; c. a material with a polar moiety; d. an alkaline earth complex material; e. a conductive primer; f. an adhesion booster; or a mixture thereof. An adhesion booster, or first protective coating, may be applied to the surface after the preparation/blasting process to protect the surface. The alkaline earth complex material may comprise one or more of alkaline earth metals, alkaline earth salts, and alkaline earth oxides.

In some embodiments, the method further comprises performing the cleaning in an outdoor setting involving runoff of the applied medium to the environment. Alternatively, the method further comprises applying the cleaning to previously paint treated metal structure in an outdoor installation as part of maintaining the structures.

Some embodiments are directed to a solution or medium for use in cleaning or removing contaminants such as metal oxide contaminants. A cleaning solution can be provided for preparing a metal surface to be ready to be treated after drying, the cleaning solution consisting essentially of dimethylethanolamine and water, wherein an amount of the dimethylethanolamine is about 0.05% or above by weight, based on the total weight of the dimethylethanolamine and water. In some embodiments, the cleaning solution consists of the dimethylethanolamine and the water. In some embodiments, the cleaning solution comprises RO, DI, purified, or tap water. The solution as used in application as described herein can result in leaving the surface with about 0-3 ppm of chlorides, about 0-3 ppm of nitrates, and about 0-3 ppm of sulfates. In some embodiments, an abrasive is added to the cleaning solution. In some embodiments, a non-fugitive electron transport material is added to the cleaning solution as a surface passivator. In some embodiments, the non-fugitive electron transport materials are selected from the group of a. a conjugated polymer; b. a high charge polymer; c. a material with a polar moiety; d. an alkaline earth complex material; e. a conductive primer; f an adhesion booster; and a mixture thereof. In some embodiments, the amount of the dimethylethanolamine is about 0.18% or above by weight, based on the total weight of the dimethylethanolamine and the water. In some embodiments, the amount of the dimethylethanolamine is about 0.72% or above by weight, based on the total weight of the dimethylethanolamine and the water. In some embodiments involving the alkaline earth complex materials, the material comprises one or more of alkaline earth metals, alkaline earth salts, and alkaline earth oxides.

DETAILED DESCRIPTION OF THE PREFERRED EMBODIMENTS

Figure 1:
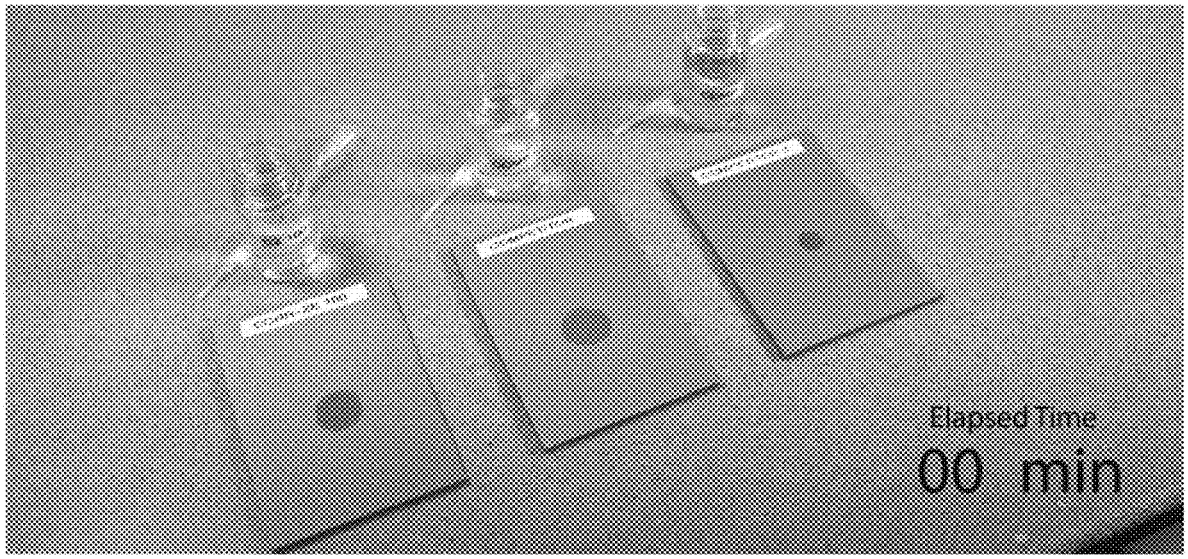
FIG. 1 illustrates three mental surfaces just after Corr-Ze 100 (the leftmost one) and products from other companies (middle and the rightmost ones) are applied.

The inventors have discovered an unexpected and surprising performance of a cleaning process. They accidentally discovered during their general use or testing of their products that in certain situations, the prepared metal surface provided superior characteristics such as significantly better bond strength when coated and also being able to resist degradation from the environment for a much longer period than other commercialized single-step washes. The inventors found that in these samples the surface preparation or removal of metal contaminants only involved impingement applied to the surface and the application of a medium that only contained water and dimethylethanolamine. To the inventor's surprise, these samples remained free of rust for seven days and resulted in a bond strength of 2164 PSI with a two-coat epoxy and urethane topcoat system after a 24-hour hot water soak, which is significantly superior to known prior art.

Further in relation to this, before explaining at least the preferred embodiments of the invention in greater detail, it is to be understood that the invention is not limited in its application to the details of construction and to the arrangements of the components set forth in the following description. It would be understood by those of ordinary skill in the art that embodiments beyond those described herein are contemplated, and the embodiments can be practiced and carried out in a plurality of different ways. Also, it is to be understood that the terminology used herein is for the purpose of description and should not be regarded as a limiting factor.

Unless otherwise defined, the terms used herein refer to that which the ordinary artisan would understand such term to mean based on the contextual use of such term herein. To the extent that the meaning of a term used herein as understood by the ordinary artisan based on the contextual use of such term differs in any way from any particular dictionary definition of such term, it is intended that the meaning of the term as understood by the ordinary artisan will prevail.

As used herein, the term "substantially free of" means being present in an amount less than about 10 ppm.

As used herein, the term "free of" means being present in an amount of 0 ppm or in a non-detectable amount.

As used herein, "consists essentially of" means excluding other materials that contribute to cleaning/washing functions. The objective of the medium and therefore the process (discussed below) is to clean and remove particles such as contaminants that interfere with the maintenance and structural integrity of the paint, coating, or metal structure so that the paint or coating remains (remains longer) without breaks, cracks, or blisters that lead to rusting and repeated maintenance or structural breakage. Other materials that contribute to the cleaning/washing function that materially affect the basic and novel characteristics of the invention are not required and are potentially counterproductive because they may remain on the surface and interfere with the subsequent treatment and related bonding. In other words, the meaning of "consists essentially of" is tied to the objective and excludes materials (that contribute to the cleaning/washing functions) that materially affect the cleaning or contamination removal function of the medium. Small traces that have little or no effect to the function of the medium as part of the embodiments of the presentation invention may exist in a medium that consists essentially of dimethylethanolamine and water under the definition because it would not materially affect its function and/or objective.

As used herein, the term "about" means approximately or nearly and in the context of a numerical value or range set forth herein means±10% of the numerical value or range recited or claimed.

As used herein, the term "ultra-high pressure blasting (UHP)" means the use of ultra-high-pressure water, with or without the addition of other liquids or solid particles, to remove unwanted matter from various surfaces, and where the pump pressure exceeds about 30,000 psi (about 2,041 bar).

As used herein, the term "high pressure blasting (HP)" means the use of high-pressure water, with or without the addition of other liquids or solid particles, to remove unwanted matter from various surfaces, and where the pump pressure is between about 5,000 psi (340 bar) and about 30,000 psi (2,040 bar).

As used herein, the term "low water pressure blasting" or "pressure cleaning" means the use of pressurized water, with or without the addition of other liquids or solid particles, to remove unwanted matter from various surfaces, and where the pump pressure is below about 5,000 psi (about 340 bar).

As used herein, the term "blast pressure cleaning operation" means power washing with water or aggregate using pressure at or between about 70 psi and about 55,000 psi.

As used herein, the term "having minimal environmental impact" is a term that would be understood in the field of environmental protection.

As used herein, the term "fugitive" means evaporating completely and leaving nothing on a surface (meaning not detectable or 0 ppm).

As used herein, a "metal surface" or "metal structure" means that the object has been substantially made with metal. To the extent there are other materials used to make the object, it could be only a minor amount. It is understood in this context that the metal surface can include contaminants such as paint (such as from a previous treatment) or rust (such as from field exposure) on the surface such as before the surface is prepared for treatment.

From the prior technologies used for surface cleaning/preparation, it would be a possible option to look for a chemical system that would be fugitive upon drying. The inventors have determined that a new method for treating a surface, preferably a surface made of metal, can be performed by preparing and providing a medium comprising dimethylethanolamine (DMEA) and water; and cleaning the surface by applying the medium. In general, the surface to be treated ranges from, but is not limited to, carbon steel, stainless steel, aluminum, and concrete. In some embodiments, the medium consists of dimethylethanolamine and water. In some embodiments, the medium consists essentially of dimethylethanolamine and water. The amount of dimethylethanolamine in the medium is about 0.05% or above by weight, up to or at potentially about 40%, by weight or preferably up to or at about 18.15% by weight, based on the total weight of the dimethylethanolamine and the water. More preferably, the amount of dimethylethanolamine in the medium is about 0.18% or above by weight, based on the total weight of the dimethylethanolamine and the water. More preferably, the amount of dimethylethanolamine in the medium is about 0.72% or above by weight, based on the total weight of the dimethylethanolamine and the water. The reference to "or above" can be understood in some embodiments to include the described ranges. In addition, other contemplated ranges, including at the end point, are about 0.5% to 1%, 2%, 5%, 10%, 15%, 20%, 25%, 30%, or 35%. In some embodiments, the aforementioned media may be prepared by diluting a concentrated medium. The medium, in some embodiments, does not require multiple solutions or a two-step process. A single-step process, according to some embodiments of the present invention, in which the impingement of the aggregate or water combines with the simultaneous application of a fugitive product that cleans and does not deposit on the surface is less costly (e.g., $0.04-0.06 per square foot). Embodiments of the present invention also avoid unnecessary degradation of the substrate because it does not require application of caustic, harsh or corrosive chemicals.

To clarify, the diluted amount of dimethylethanolamine, dimethylethanolamine, by itself, and at high percentages in a water dilution such as 50% water dilution by weight is an irritant to the skin and the vapor should not be inhaled. Dimethylethanolamine is designated by government regulations as a corrosive or irritant and flammable. In this industry, the surface preparation operation is performed by humans in typically in open areas and often times in outdoor environments such as an oil platform. Working with materials that are corrosive, cause irritation, or otherwise harm humans, animals, or environment can be a detriment to the adoption and use of the technology by industry. Another consideration is cost, the cost of dimethylethanolamine is currently relatively expensive and is factored into with respect to the amount of the dimethylethanolamine to be used. In the described processes, a concentrated dimethylethanolamine water dilution is first prepared (e.g., 18.15% dimethylethanolamine by weight in water) for distribution, storage, or packaging. In use, the concentrated dimethylethanolamine water solution is further diluted to a lower dilution such as about 0.5% dimethylethanolamine by weight dissolved in water and then used as described in herein. It should be also understood that embodiments of the present invention are not limited to outdoor open air use but are applicable many other situations including enclosed or internal applications such as the cleaning the inside of storage and processing tanks.

In some embodiments, the cleaning operation involves a single step by combining the application of the medium with an operation that removes or releases particles from the surface by mechanical operation such as pressure or abrasives. Also, before or after steps are not necessarily always excluded from embodiments of the invention. In some embodiments, the cleaning operation is defined by the application of the cleaning solution and the mechanical or pressure cleaning operation. In some embodiments, no further before or after steps can be required. The resultant surface is preferably dried without any additional steps to remove particles or contaminants from the surface. The cleaning operation can be a combination of mechanical and pressure cleaning if desired. In some applications, the cleaning operation is performed in the field, public, or open spaces where techniques such as conventional chemical cleaning would not be appropriate or permitted for example due to environmental impact or regulations.

In embodiments of the present invention, the prepared or provided medium may be applied to a surface, preferably a surface made of metal, using pressure cleaning operation or action (to the surface) which can include pressure water blasting such as ultra-high pressure blasting (UHP) (e.g., "hydrocat" UHP blasting system, "deckhog" UHP blasting system, "hand lances" UHP blasting system, "pipeline cleaning pig" UHP blasting system), above about 30,000 psi. Alternatively, the medium may be applied to a surface, preferably a surface made of metal, using high pressure blasting (HP) or low pressure water blasting (or pressure cleaning). In some embodiments, the pump pressure used for pressure water blasting is at or above about 500, 750, 1,000, 1500, 2000, 3,000, 4000, 5,000, 7500, 10,000, 15000 or 20,000 psi. Other nozzle pressures are also contemplated or described.

In some embodiments, the medium may be applied to a surface, preferably a metal surface using a mechanical cleaning operation or action blasting (e.g., vapor blasting) or mechanical abrasion method. Optionally, abrasive (e.g., Glass Beads, Garnet, Black Beauty Aggregate, Sodium Bicarbonate, Walnut Shell Aggregate, Sponge Aggregate)

may be applied to the surface with the medium using ultra-high pressure blasting (UHP), high pressure blasting (HP), low pressure blasting (or pressure cleaning), vapor blasting or mechanical abrasion (e.g., bristle blaster). Wet Abrasive Blast Cleaning (WAB) is the paint industry's term for including abrasives or solids, in low to ultra-high pressure water cleaning. WAB covers abrasives added to water streams or water added to abrasive streams, in amounts ranging from mostly abrasive with a little water to mostly water with a little abrasive and can be used in embodiments of the invention, for example, as mentioned herein. Generic terms to describe specific air/water/abrasive blast cleaning methods are water-shroud or wet-head blasting, wet blasting, low volume water abrasive blasting, and slurry blasting. Generic terms to describe specific water/abrasive blast cleaning methods are slurry blasting, abrasive water jetting (AWJ), or abrasive injected water jetting/blasting (AIWJ). For blasting with abrasives, it is commonly accepted that low salt levels on blast media results in a cleaner blast. In some embodiments, the medium is applied after abrasive, ultra-high pressure, vapor blasting, hand, mechanical, or laser blasting preparation of the surface. In the instance, the medium applied to the surface after the surface preparation is preferably concentrated to afford optimal results and create minimum runoff. In some embodiments, the medium is only applied after the preparation/blasting process. To clarify, the above discussion of pressures is applicable to the various blasting or cleaning methods.

To further elaborate and clarify, the medium is applied to the surface that is the subject of the cleaning as part of a cleaning process that includes applying a physical cleaning action to the surface (as described mechanical or pressure cleaning action). The medium can be applied under pressure such as 500 or above or it can be applied at a much lower pressure such as in vapor blasting in which a water mist is generated to suppress dust, and in that case the medium is applied using the mist, for example. In some embodiments, the application of the medium and mechanical or pressure cleaning operation are concurrent, simultaneous (e.g., simultaneous throughout), continuous (e.g., applied continuously and simultaneously), overlap, or performed without overlap.

In desired embodiments, the surface treated with tap water such as tap water (e.g., having 310 ppm of total solids in water) (is substantially free of and has typically low levels of chlorides, nitrates, carbonates (e.g., oxides), sulfates (surface and ground water, the main sources for tap water, are loaded with sulfates), or salts thereof. The higher sulfate content is noted in our original testing. More preferably, the surface treated with RO, DI, or is free of chlorides, nitrates, carbonates, sulfates, or salts thereof. DI and distilled are the purest, while RO is capable of making potable water or DI water, and purified water is typically free of visible contaminants. The preferred embodiment is with low conductivity water, and embodiments of this invention performs well with purified water. Purified water is water that has been mechanically filtered or processed to remove impurities and make it suitable for use. Distilled water was, formerly, the most common form of purified water, but research has shown that water is more frequently purified by other processes including capacitive deionization, reverse osmosis, carbon filtering, microfiltration, ultrafiltration, and ultraviolet oxidation.

In some embodiments, the surface treated with tap water (e.g., having 310 ppm of total solids in water) and DMEA may have about 0-1, 0-2, or 0-3 ppm of chlorides, about 0-1, 0-2, or 0-3 ppm of nitrates, and about 0-1, 0-2, 0-3, 0-4, 0-5, 0-6, 0-7, 0-8, 0-9, or 0-10 ppm of sulfates. In some embodiments, the surface treated with RO, DI, or distilled water that contains much less total solids than tap water or unpurified water may have about 0-1, 0-2, or 0-3 ppm of chlorides, about 0-1, 0-2, or 0-3 ppm of nitrates, and about 0-1, 0-2, or 0-3 ppm of sulfates. For the present purposes, RO (reverse osmosis) water will be considered to be the result of running water such as sea water through an RO unit to desalinate in order to remove chlorides from the water. This work will not include, by definition, RO systems that can filter water that would be equivalent to deionized water. For example, RO water sources can be RO units that have converted water from the Gulf of Mexico into potable water, which on oil platforms provides a highly convenient and accessible source for maintenance operations. This RO water is about equivalent to a city tap water source. DI water is deionized water such as that which is the result of running tap water through mixed bed resins to remove soluble salts. For this work we will consider purified water to be water that is passed through a carbon filter to remove chlorine bleach, halogenated VOC's, but not water soluble salts.

The ability to use tap water in applying embodiments of the present invention provide significant advantages to users in operation and costs. The methods can be applied by simply connecting to the local water tap without requiring the use of treated water which will likely require additional steps or transportation of water, which can significantly increase costs and time.

Example 1—Deionized Water and DMEA

The Inventors tested (1) Cleanwirx 207 (using the formulation and instructions in the market in 2020) at 1%, or approximately 0.21% solids, in tap water containing 310 ppm total solids; (2) 0.18% of DMEA by weight in tap water containing 310 ppm total solids, based on the total weight of dimethylethanolamine and water; and (3) 0.72% of DMEA by weight in tap water containing 310 ppm total solids, based on the total weight of dimethylethanolamine and water. The testing was conducted using vapor blasting, which involves the application of an abrasive via the blasting equipment to clean with surface in conjunction with a spray that applies the solution.

| Cleanwirx 207 Treated Steel Plate | |
|---|---|
| Initial Chloride Test | 22 ppm |
| Subsequent Chloride Test | 1-2 ppm |
| Nitrates | 0 ppm |
| Sulfates | 10 ppm |

| Deionized water and 0.18% of DMEA Treated Steel Plate | |
|---|---|
| Initial Chloride Test | 30 ppm |
| Subsequent Chloride Test | 0 ppm |
| Nitrates | 0 ppm |
| Sulfates | 5 ppm |

| Deionized water and 0.72% of DMEA Treated Steel Plate | |
|---|---|
| Initial Chloride Test | 25 ppm |
| Subsequent Chloride Test | 0 ppm |
| Nitrates | 0 ppm |
| Sulfates | 5 ppm |

Weather conditions for testing is as follows: Ambient: 80 degrees F., RH %: 57, DP: 63 degrees F., Steel Temp.: 82 degrees F., ~4% Cloud Cover. All solutions were made using tap water with 310 total dissolved solids. The sample treated with 1% Cleanwirx 207 exhibited a visual sheen or matte finish that dried slower than the other test plates. The sample treated with 0.18% of DMEA exhibited no sheen with a wet appearance that began to dry quickly. The sample treated with 0.72% of DMEA exhibited no sheen with a wet appearance that began to dry quickly.

This process has been used extensively in the Gulf of Mexico on offshore platforms in which steel substrates are heavily corroded and deeply pitted. In this environment this steel would begin to flash rust immediately, embodiments of this invention (per the above example) preclude the flash rusting without leaving a residue or film. In shop and field demonstrations the inventors have applied the product in conjunction with blasting and then applied tap water to demonstrate the passive state of the steel substrate. This example shows that a DMEA solution is an excellent remover of soluble salts (e.g., chlorides, nitrates, and sulfates), which offers a significant advantage over traditional blasting only. When a DMEA solution applied to a substrate with a blasting method (e.g., before, after, or simultaneously), it can effectively remove both soluble salts (e.g., chlorides, nitrates, and sulfates) and non-soluble salts), blast media, and flash rust).

In reference back to the above example, visual inspection this same day revealed comparative flash rusting between the sample treated by Cleanwirx 207 and the sample treated with tap water and 0.18% of DMEA, while the sample treated with tap water and 0.72% of DMEA still maintained minimal flash rusting. The testing has shown significant performance over known cleaning or maintenance operation in that the application of the water and DMEA (e.g., by itself) as part of the cleaning operation resulted in a surface with no film or harmful particles that will interfere or reduce the effectiveness of the maintenance coating.

The inventors have also determined that there is a correlation between cleaning performance and water quality. Running through a carbon filter to remove hypochlorite salts, chloramines, and organohalides may yield acceptable results for some water sources. However, for water sources with chlorides or high salt levels, further purification will produce a cleaner surface. RO (reverse osmosis) water, DI (deionized) water, or any purified water that contains a low amount of contaminants is preferred. Applied with the new method, the solution left no residue except for salts contained by the water that did not rinse off and was left to dry on the surface. It is believed the present water/fugitive amine system can perform as well as or better than systems used in prior art, without leaving behind potentially deleterious polar materials that may assist in creating anodic and cathodic sites on the surface. This can aid in achieving increased adhesion and extend the service life of protective coatings, compared to prior art.

One of the best descriptions of prior art that leaves behind a protective amine film, whether using a one-step process or a two-step process, is found in U.S. Pat. No. 4,590,100, to Peter J. Hearst. The Hearst patent teaches the importance of leaving behind a small amount of protective amine coating (to provide a prepared surface that is ready for treatment) and teaches that the protective amine coating is incorporated into the non-aqueous protective coatings upon the treatment application. The most popular surface preparations today use this technology and are pleased to do so to pass inspection prior to coating. The inventors of the herein application teach the contrary, that water soluble film formers detract from the coating's ability to perform optimally. A preferred method, as in the case of embodiments of the present invention, would have increased passivation over that of clean, dry steel. In the present application, a non-fugitive electron transport material may be added to the medium as a surface passivator. In some embodiments, the non-fugitive electron transport materials are selected from the group of a. a conjugated polymer; b. a high charge polymer; c. a material with a polar moiety; d. an alkaline earth complex material; e. a conductive primer; f an adhesion booster; and a mixture thereof. For example, an adhesion booster, or first protective coating, is applied to the surface after the preparation/blasting process to protect the surface. The medium preferably has minimal environmental impact such that it can be run-off into water after treatment, for example, from offshore facilities. For example, for the purpose of having minimal environmental impact, the following chemicals would not be used: N-hydroxyformamide, formic acid, and ammonium salts.

The present application is also directed to a cleaning solution for cleaning a surface, preferably a metal surface, the cleaning solution comprising dimethylethanolamine and water, which forms a fugitive alkaline solution. In some embodiments, the cleaning solution consists of dimethylethanolamine and water. In some embodiments, the cleaning solution consists essentially of dimethylethanolamine and water. The amount of dimethylethanolamine in the cleaning solution is about 0.05% or above by weight, based on the total weight of the dimethylethanolamine and the water. More preferably, the amount of dimethylethanolamine in the cleaning solution is about 0.18% or above by weight, based on the total weight of the dimethylethanolamine and the water. More preferably, the amount of dimethylethanolamine in the cleaning solution is about 0.72% or above by weight, based on the total weight of the dimethylethanolamine and the water. In some embodiments, water includes RO (reverse osmosis) water, DI (deionized) water, or any purified water that preferably contains a low amount of contaminants. Optionally, a non-fugitive electron transport material may be added to the medium as a surface passivator. In some embodiments, the non-fugitive electron transport materials are selected from the group of a. a conjugated polymer; b. a high charge polymer; c. a material with a polar moiety; d. an alkaline earth complex material; e. a conductive primer; f. an adhesion booster; and a mixture thereof. The alkaline earth complex material may comprise one or more of alkaline earth metals, alkaline earth salts, and alkaline earth oxides.

Some of the new nanocoating technologies require a clean neutral surface. The above-mentioned prior art amine film forming washes leave behind an alkaline surface that interferes with the coating, resulting in coating failures.

The new treatment method and cleaning solution described herein can fit into the daily blast/coat process that some applicators have been using. Embodiments of the invention can also have a wide range of applications including as noted in maintenance applications in which a protective coating is applied after the cleaning operation as part of the maintenance application. The coating can be applied immediately thereafter or can be applied after a longer period because of the improved performance of the cleaning operation. Numerous other applications and their benefits include the following: 1) applying the cleaning solution or medium to extend the service life of water cooled low "wet end" pumps, low, medium, high and ultra-high pressure pumps; 2) applying the cleaning solution or medium to UHP blasting achieving the surface preparation standards required for intumescent fireproofing that previously was not available (the requirement was for dry abrasive blast only due to the formation of the hydrated iron oxide layer.); 3) applying the cleaning solution or medium in low, medium, high and ultra-high pressure water blasting of exchanger tubes; 4) applying the cleaning solution or medium in high pressure water blasting of exchanger tubes in preparation for eddy current inspection to prevent flash rusting. Eddy current inspection needs a clean surface to carry the current. The application of the product simultaneously eliminates the requirement for rework and remobilization of cleaning crews to reblast the surface. Similarly, embodiments of the present invention can be used for simultaneously blasting and applying the cleaning solution or medium to internals of pipeline to prevent flash rusting prior to smart pig application for scanning and mapping. A subsequent flushing and passivation of the surface can be followed.

The solution pH depends on the water source, but typically a 0.18% solution will be around pH 10. The invention works at the temperatures water is liquid.

Example 2—Corr-Ze 100 (which is an Embodiment of the Present Invention)

Figure 2:
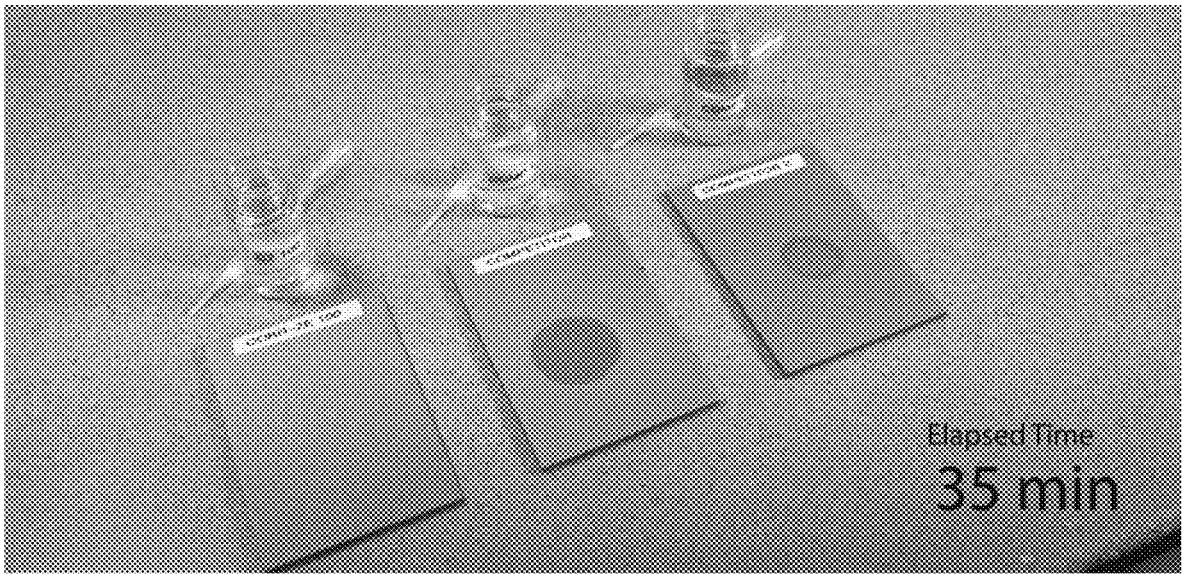
FIG. 2 illustrates three metal surfaces 35 minutes after Corr-Ze 100 (the leftmost one) and products from other companies (middle and the rightmost ones) are applied.
Figure 3:
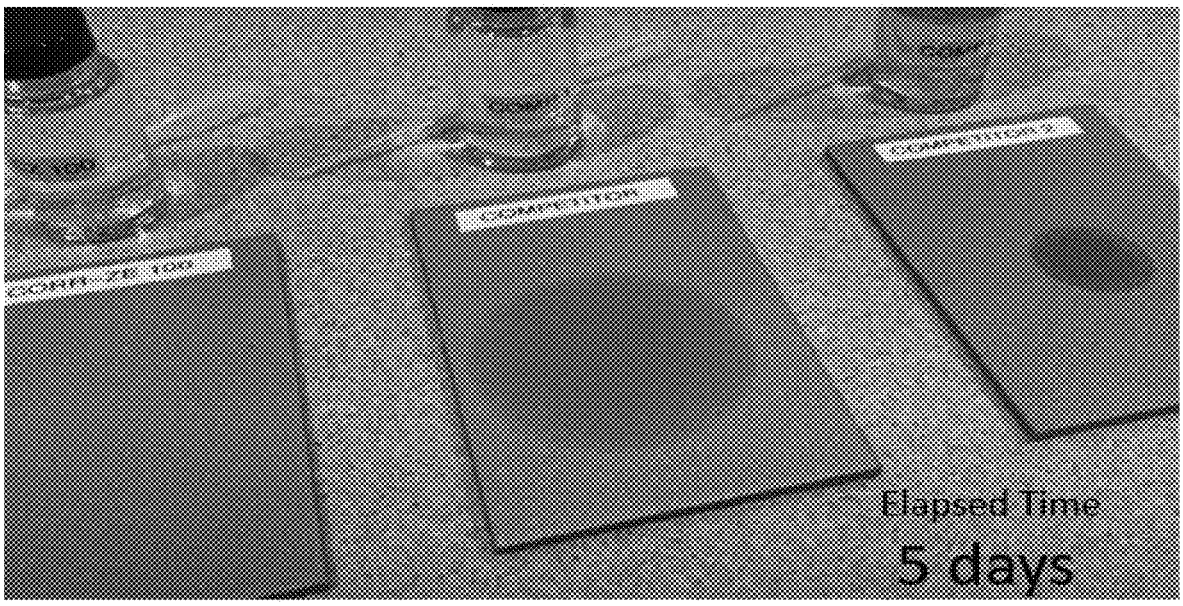
FIG. 3 illustrates three metal surfaces 5 days after Corr-Ze 100 (the leftmost one) and products from other companies (middle and the rightmost ones) are applied.

As can be seen from the FIGS. 1 and 2, Corr-Ze 100 is fugitive upon drying only after about 30 minutes. As shown, no film is formed and no residue is left on the metal surface upon drying. On the other hand, products from other companies (i.e., competitors 1 and 2) formed a film upon drying even after 5 days. In this experiment, Corr-Ze 100 is 18.15% DMEA in deionized water, Competitor 1 is ~25% triethanolamine in deionized water, and Competitor 2 is ~20% DMEA and ~1.7% sulfate salt in deionized water. In this example, no other materials were mixed into the solutions but it would be understood by those of ordinary skill in the art that small amount of other materials would not have a material effect on the demonstrated results. Corr-Ze 100 can be applied at the same time or after applying a mechanical cleaning operation or pressure cleaning operation (or both). The operation can include, but not be limited to, an abrasive, ultra-high pressure, vapor blasting, slurry blasting, hand, mechanical, or laser blasting preparation of the surface. By eliminating contaminants, Corr-Ze 100 ensures that the coating systems have higher bonding strength and longer service life. For example, it can be used with any coating system and is an excellent remover of soluble salt and other non-visible contaminates in industrial, offshore structures, pulp and paper plants, bridges and environments in both atmospheric exposure and immersion service systems. In practice, 1 gallon of Corr-Ze 100 can be diluted with 100 gallons or 200 gallons of preferably deionized water before use.

Known cleaning techniques can have deficiencies that are addressed by embodiments of the current invention. For example, embodiments of the present invention, as described herein, clean a surface to be ready for coating and achieve the condition of the surface to be ready for a coating by applying an impingement process combined with a water DMEA solution without involving or requiring detergents or caustic chemicals to clean the surface. Embodiments of the present invention have been found to be provide exceptional or surprising level of performance such as by remaining free of rust or have exceptional bond strength when coated. DEMA possesses physical properties such as volatility (e.g., higher vapor pressure and lower boiling point than Triethanolamine) that the inventors believe to support the described performance of embodiments of the present invention.

A single step wash solution for providing a prepared surface for maintenance, coating, or painting comprising, consisting essentially of, or consisting of DMEA and water in accordance with the descriptions and ranges herein, wherein no other cleaning solution or gel is applied in conjunction with the wash solution. The single step wash solution for example removes surface contaminants from metal surfaces and is the only chemical solution that is applied with the objective of cleaning the surface in the complete cleaning operation.

Testing has shown and the inventors have discovered the method for contamination removal and provided a prepared surface is implemented without the application of harsh chemical(s) (such as acids that are incorporated with the objective function of reacting with material to dissolve or remove them). (The use of harsh chemicals has advantages such as the ability to reach small recesses or cavities, but testing has surprising shown that embodiments of the present invention comprising a clean process as described herein and without the application of caustic chemical can provide better performance.)

These processes leave the surface with a neutral pH surface. This especially important for some of the new high-grade nano-coatings.

It is further highlighted that the diluted DMEA water solution, as described herein, is nonflammble and also nonirritating to humans and animals which makes the product and method more convenient and easier to use than cleaning with harsh chemicals.

It should be understood that variations, clarifications, or modifications are contemplated. Applications of the technology to other fields not mentioned are also contemplated.

Exemplary methods and compositions are described. Since numerous modifications and changes will readily be apparent to those having ordinary skill in the art, it is not desired to limit the invention to only the exact constructions as demonstrated in this disclosure. Accordingly, all suitable modifications and equivalents may be resorted to falling within the scope of the invention.

Thus, for example, any sequence(s) and/or temporal order of steps of various processes or methods that are described herein are illustrative and should not be interpreted as being restrictive except as it would be generally understood from the context and description. Accordingly, it should be understood that although steps of various processes or methods or connections or sequence of operations may be shown and described as being in a sequence or temporal order, but they are not necessarily limited to being carried out in any particular sequence or order. For example, the steps in such processes or methods generally may be carried out in various different sequences and orders, while still falling within the scope of the present invention.

It should be understood that claims that include fewer limitations, broader claims, such as claims without requiring a certain feature or process step in the appended claim or in the specification, clarifications to the claim elements, different combinations, and alternative implementations based on the specification, or different uses, are also contemplated by the embodiments of the present invention.

It should be understood that combinations of described features or steps are contemplated even if they are not described directly together or not in the same context.

The terms or words that are used herein are directed to those of ordinary skill in the art in this field of technology and the meaning of those terms or words will be understood from terminology used in that field or can be reasonably interpreted based on the plain English meaning of the words in conjunction with knowledge in this field of technology. This includes an understanding of implicit features that for example may involve multiple possibilities, but to a person of ordinary skill in the art a reasonable or primary understanding or meaning is understood.

Unless defined otherwise, all technical and scientific terms used herein have same meaning as commonly understood by the person of ordinary skill in the art to which this invention belongs.

It should be understood that the above description of the invention and specific examples, while indicating preferred embodiments of the present invention, are given by way of illustration and not limitation. Many changes and modifications within the scope of the present invention may be made without departing from the spirit thereof, and the present invention includes all such changes and modifications.

What is claimed is:

1. A method for metal decontamination, the method comprising:

cleaning a metal surface by applying a medium consisting essentially of dimethylethanolamine and Reverse Osmosis, Deionized, purified or tap water, applying a mechanical cleaning operation or blast pressure cleaning operation to the metal surface, and without applying a caustic or chemical cleaning operation to the metal surface prior to applying the medium, wherein an amount of the dimethylethanolamine is about 0.05% or above, to a maximum at about 40%, by weight, based on the total weight of the dimethylethanolamine and the water, whereby the treatment leaves the surface with about 0-3 ppm of chlorides, about 0-3 ppm of nitrates, and about 0-10 ppm of sulfates without leaving a film on the surface.

2. The method of claim 1, wherein the medium has minimal environmental impact.

3. The method of claim 1, wherein an abrasive material is applied using vapor abrasive blasting in conjunction with the medium being applied to the surface.

4. The method of claim 1, wherein the medium is applied at the same time or after applying a mechanical cleaning operation or pressure cleaning operation or both, where the operation can comprise an abrasive, ultra-high pressure, vapor blasting, slurry blasting, hand, mechanical, or laser blasting preparation of the surface.

5. The method of claim 1, wherein the medium is applied to the surface in a soak bath.

6. The method of claim 1, wherein a non-fugitive electron transport material is added to the medium as a surface passivator.

7. The method of claim 6, wherein the non-fugitive electron transport materials are selected from the group consisting of:

a. a conjugated polymer;
b. a high charge polymer;
c. a material with a polar moiety;
d. an alkaline earth complex material;
e. a conductive primer;
f. an adhesion booster; and a mixture thereof.

8. The method of claim 1, wherein the medium is only applied after the mechanical or pressure cleaning operation.

9. The method of claim 1, wherein an adhesion booster, or first protective coating, is applied to the surface after the cleaning to protect the surface.

10. The method of claim 1 further comprising performing the cleaning in an outdoor setting involving runoff of the applied medium to the environment.

11. The method of claim 1 further comprising applying the cleaning to previously paint treated metal structure in an outdoor installation as part of maintaining the structures.

12. The method of claim 7, wherein the alkaline earth complex material comprises one or more of alkaline earth metals, alkaline earth salts, and alkaline earth oxides.

13. A method for metal decontamination, the method comprising:

cleaning a metal surface by applying a medium consisting of dimethylethanolamine and Reverse Osmosis, Deionized, purified or tap water and a non-fugitive electron transport material added to the medium as a surface passivator, applying a mechanical cleaning operation or blast pressure cleaning operation to the metal surface, and without applying a caustic or chemical cleaning operation to the metal surface prior to applying the medium, whereby the treatment leaves the surface with about 0-3 ppm of chlorides, about 0-3 ppm of nitrates, and about 0-10 ppm of sulfates without leaving a film on the surface.

14. The method of claim 13, wherein an amount of the dimethylethanolamine is about 0.05% or above by weight, to about 40% by weight, based on the total weight of the dimethylethanolamine and water.

15. The method of claim 14, whereby the treatment leaves the surface with about 0-3 ppm of chlorides, about 0-3 ppm of nitrates, and about 0-3 ppm of sulfates when using Deionized water.

16. The method of claim 13, wherein the medium has minimal environmental impact.

17. The method of claim 13, wherein an abrasive material is applied using vapor abrasive blasting in conjunction with the medium being applied to the surface.

18. The method of claim 13, wherein the medium is applied at the same time or after applying a mechanical cleaning operation or pressure cleaning operation or both, where the operation can include an abrasive, ultra-high pressure, vapor blasting, slurry blasting, hand, mechanical, or laser blasting preparation of the surface.

19. The method of claim 13, wherein the medium is applied to the surface in a soak bath.

20. The method of claim 13, wherein the non-fugitive electron transport materials are selected from the group consisting of:

a. a conjugated polymer;
b. a high charge polymer;
c. a material with a polar moiety;
d. an alkaline earth complex material;
e. a conductive primer;
f. an adhesion booster; and a mixture thereof.

21. The method of claim 13, wherein the medium is only applied after the mechanical or pressure cleaning operation.

22. The method of claim 13, wherein an adhesion booster, or first protective coating, is applied to the surface after the cleaning to protect the surface.

23. The method of claim 14, wherein the amount of the dimethylethanolamine is about 0.18% or above by weight, to about 40% weight, based on the total weight of the dimethylethanolamine and the water.

24. The method of claim 13, wherein the amount of the dimethylethanolamine is about 0.72% or above by weight, to about 40% by weight, based on the total weight of the dimethylethanolamine and the water.

25. The method of claim 13 further comprising performing the cleaning in an outdoor setting involving runoff of the applied medium to the environment.

* * * * *